United States Patent [19]

Vermeulen et al.

[11] Patent Number: 4,902,593

[45] Date of Patent: Feb. 20, 1990

[54] DYE IMAGE RECEIVING MATERIAL

[75] Inventors: Leon L. Vermeulen, Herenthout; Ludovicus H. Vervloet, Kessel; Willy P. De Smedt, Mechlin; Piet Kok, Ghent, all of Belgium

[73] Assignee: Agfa-Gevaert, N.V., Mortsel, Belgium

[21] Appl. No.: 243,835

[22] Filed: Sep. 13, 1988

[30] Foreign Application Priority Data

Sep. 29, 1987 [BE] Belgium ..... 87201865

[51] Int. Cl.[4] ..... G03C 5/54; G03C 1/80; G03C 1/76

[52] U.S. Cl. ..... 430/10; 430/14; 430/212; 430/213; 430/215; 430/533; 430/534; 428/423.5; 428/423.3

[58] Field of Search ..... 430/212, 213, 215, 533, 430/534, 10, 14; 428/423.5, 423.3

[56] References Cited

U.S. PATENT DOCUMENTS

| | | | |
|---|---|---|---|
| 3,397,989 | 8/1968 | Keberie et al. | 430/628 |
| 4,186,014 | 1/1980 | Bergthaller et al. | 430/213 |
| 4,388,403 | 6/1983 | Helling et al. | 430/546 |
| 4,425,421 | 1/1984 | Rutges et al. | 430/213 |
| 4,429,032 | 1/1984 | Matthe et al. | 430/231 |

*Primary Examiner*—Richard L. Schilling
*Attorney, Agent, or Firm*—A. W. Breiner

[57] ABSTRACT

An image-receiving material suitable for image production by dye diffusion transfer processing controlled by the development of (an) image-wise exposed silver halide emulsion layer(s), wherein said image-receiving material contains a hydrophobic resin support coated with a subbing layer that is coated with an image-receiving layer containing gelatin in combination with a cationic polymeric mordant containing glycidyl groups that can react with active hydrogen atoms of gelatin, the weight ratio of said polymeric mordant to gelatin being 25:1 to 1:1 and the gelatin being present at a coverage of at least 0.1 g per m2, and wherein said subbing layer has been applied from an aqueous composition comprising a polyester-polyurethane wherein isocyanate groups still present in its structure have reacted with an ionomeric compound containing at least one active hydrogen atom and a carboxylate or sulphonate salt group.

10 Claims, No Drawings

DYE IMAGE RECEIVING MATERIAL

DESCRIPTION

The present invention relates to a material containing an image receiving layer suitable for carrying out a dye diffusion transfer process controlled by the development of a photo-exposed silver halide emulsion layer.

The use of image receiving materials in the silver complex diffusion transferreversal (DTR-) process is well known state of the art.

Dye diffusion transfer reversal processes are based on the image-wise transfer of diffusible dye molecules from an image-wise exposed silver halide emulsion material into a waterpermeable image-receiving layer containing a mordant for the dye(s). The image-wise diffusion of the dye(s) is controlled by the development of one or more image-wise exposed silver halide emulsion layers, that for the production of a multicolor image are differently spectrally sensitized and contain respectively a yellow, magenta and cyan dye molecules. A survey of dye diffusion transfer imaging processes has been given by Christian C. Van de Sande in Angew. Chem. - Ed. Engl. 22 (1983) No. 3, 191–209.

For use in dye diffusion transfer photography the type of mrdant chosen will depend upon the dye to be mordanted. If acid dyes are to be mordanted, the image-receiving layer contains basic polymeric mordants such as polymers of amino-guanidine derivatives of vinyl methyl ketone such as described in U.S. Pat. No. 2,882,156, and basic polymeric mordants and derivatives, e.g. poly-4-vinylpyridine, the metho-po-toluene sulphonate of poly-2-vinylpyridine and similar compounds described in U.S. Pat. No. 2,484,430, and the compounds described in the published DE-A 2,009,498 and 2,200,063. Other mordants are long-chain quaternary ammonium or phosphonium compounds or ternary sulphonium compounds, e.g. those described in U.S. Pat. Nos. 3,271,147 and 3,271,148,, and cetyltrimethyl-ammonium bromide. Certain metal salts and their hydroxides that form sparingly soluble compounds with the acid dyes may be used too. The dye mordants are dispersed or molecularly divided in one of the usual hydrophilic binders in the image-receiving layer, e.g. in gelatin, polyvinylpyrrolidone or partly or completely hydrolysed cellulose esters.

In U.S. Pat. No. 4,186,014 cationic polymeric mordants are described that are particularly suited for fixing anionic dyes, e.g. sulphinic acid salt dyes that are image-wise released by a redox-reaction described e.g. in in published EP-A 0,004,399 and U.S. Pat. No. 4,232,107.

Said cationic polymeric mordants contain glycidyl groups that can react with active hydrogen atoms being present in gelatin serving as binding agent. Such polymers can be made by quaternizing a basic polyurethane, polyurea or polyurea-polyurethane with a quaternizing agent capable of introducing glycidyl groups.

According to U.S. Pat. No. 4,186,014 the mordant layer acting as dye image-receiving layer contains preferably said cationic polymeric mordant in quantities of from 10 to 70% by weight based on the total solids content of the mordant layer.

The production of colour photographs by the dye diffusion transfer process is a very convenient method especially for the production of identification cards containing a colour photograph of the person to be identified.

Since identification cards have to be tamperproof there are strong requirements with regard to the adherence of the dye image-receiving layer to its support and covering layer in dry as well as in wet state.

It is an object of the present invention to provide an image receiving material for use in image formation by dye diffusion transfer processing in a dye image-receiving material containing a mordant on a hydrophobic resin support wherein the adherence of said image-receiving layer to said support proceeds with a special subbing layer.

It is an other object of the present invention to use said dye image-receiving material in the production of a strongly sealed laminate serving as identification document.

Other objects and advantages of the present invention will appear from the following description.

In accordance with the present invention a dye image-receiving material suitable for image production by dye diffusion transfer processing controlled by development of (an) image-wise exposed silver halide emulsion layer(s) is provided, wherein said image-receiving material contains a hydrophobic resin support coated with a subbing layer that is coated with said iamge-receiving layer containing gelatin in combination with a cationic polymeric mordant containing glycidyl groups that can react with active hydrogen atoms of gelatin, characterized in that the weight ratio of said polymeric mordant to gelatin in said image receiving layer is between 25:1 to 1:1 and the gelatin is present therein at a converage of at least 0.1 g per m2, and in that said subbing layer has been applied from an aqueous composition comprising a polyester-polyurethane wherein isocyanate groups still present in its structure have reacted with an ionomeric compound containing at least one active hydrogen atom and a carboxylate or sulphonate salt group forming an anionic polyester-polyurethane.

The preparation of such anionic polyester-polyurethanes is described in U.S. Pat. No. 3,397,989 and U.S. Pat. No. 4,388,403.

The quantity of said salt groups is sufficient to make the anionic polyester-polyurethane dispersable in aqueous medium optionally in the presence of a water-miscible solvent.

Preferably the sulfonate and/or carboxylate groups total from 0.5 to 15% by weight with respect to the anionic polyester-polyurethane.

The polyester-polyurethane used as starting compound in the reaction with said ionmeric compound is preferably-a polyurethane of an essentially linear polyester compound that has two terminal hydroxyl groups, the polyester having preferably a molecular weight of about 300 to about 20,000.

Preferred anionic polyester-polyurethanes for use according to the present invention in the production of a subbing layer on a hydrophobic resin support contain linear polyester structural parts corresponding with a polyester derived from a dicarboxylic acid containing up to 6 carbon atoms and a polyhydric aliphatic alcohol containing up to 6 carbon atoms.

In said subbing layer gelatin is optionally present. The gelatin content may be in the range of 0% to 25% with respect to the anionic polyester-polyurethane.

An anionic polyester-polyurethane that is particularly suited for use in a subbing layer applied according to the present invention, either or not in combination with gelatin, is called "ingredient A". Ingredient A is the reaction product of:

(a) the polyester of adipic acid and hexanediol with average molecular weight 840, (23%).
(b) 4,4'-diisocyanato-dicyclohexylmethane (14%)
(3) dimethylolpropionic acid (2%),
(4) trimethylamine (1.5%), the given percentages are by weight. Ingredient A is used dispersed in water containing 7.5% by weight of N-methylpyrrolidinone.

The subbing layer composition for use according to the present invention preferably also contains a siloxane compound. Preferred siloxane compounds for use according to the present invention are within the scope of the following general formula:

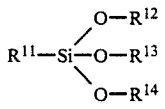

wherein:

$R^{11}$ represents a chemical group capable of a polymerization reaction or reactive with respect to amino and/or hydroxyl groups present in proteinaceous material such a gelatin and caseine, more particularly is a group containing reactive halogen such as a reactive chlorine atom, an epoxy group or an alpha,beta-ethylenically unsaturated group, representatives of such groups being e.g. the following:

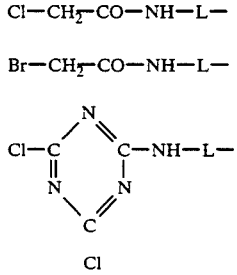

-continued

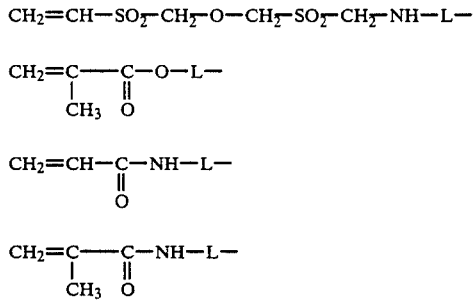

wherein L represents an alkylene group preferably a $C_1$-$C_4$ alkylene group, or $R^{11}$ represents the group:

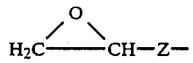

wherein Z is a bivalent hydrocarbon chain including such chain interrupted by oxygen, e.g. is a $—CH_2—O(CH_2)_3—$ group, or a bivalent hydrocarbon group that is linked at the side of the silicon atom to oxygen, e.g. is a $—CH_2—O—$ group, and each of $R^{12}$, $R^{13}$ and $R^{14}$ (same or different) represents a hydrocarbon group including a substituted hydrocarbon group e.g. methyl and ethyl.

Siloxane compounds according to the above general formula are described in U.S. Pat. No. 3,661,584 and GB-P 1,286,467 as compounds improving the adherence of proteinaceous colloid compositions to glass.

Examples of particularly useful siloxane compounds are listed in the following table 1.

TABLE 1

1.

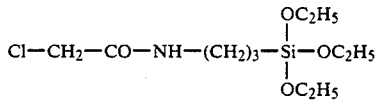

2.

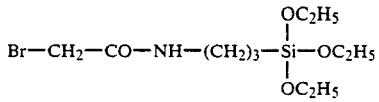

3.

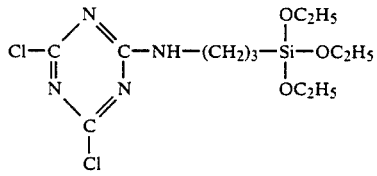

4.

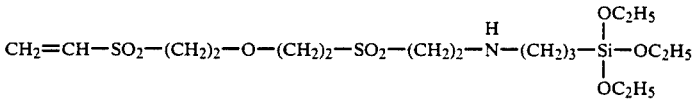

TABLE 1-continued

| | |
|---|---|
| 5. | $CH_2(\diagup O \diagdown)CH-CH_2-O-(CH_2)_3-Si(OCH_3)_3$ |
| 6. | $CH_2=CH-C(=O)-NH-(CH_2)_3-Si(OC_2H_5)_3$ |
| 7. | $CH_2=C(CH_3)-C(=O)-NH-(CH_2)_3-Si(OC_2H_5)_3$ |

The siloxane compounds are preferably used in a ratio by weight with respect to the anionic polyester-polyurethane in the range of 0:1 to 0.15:1.

Hydrophobic resin supports whereto said subbing layer provides a good anchorage for a mordant layer as defined above are made of e.g. polyester resin, polycarbonates of bis-phenols, polyolefins, e.g. polyethylene and polypropylene, polystyrene or a vinyl chloride polymer. The latter polymer is particularly suited for forming laminates by heat-sealing.

The term "vinyl chloride polymer" includes the homopolymer, as well as any copolymer containing at least 50% by weight of vinyl chloride units and including no hydrophilic recurring units.

Vinyl chloride copolymers serving as the support may contain one or more of the following coomers: vinylidene chloride, vinyl acetate, acrlonitrile, styrene, butadiene, chloroprene, dichlorobutadiene, vinyl fluoride, vinylidene fluoride, trifluorochloroethylene, and tetrafluoroethylene.

The vinyl chloride polymer serving as the support may be chlorinated to contaon 60-65% by weight of chlorine.

Many properties of polyvinyl chloride and its copolymers are improved by plasticization and their stability can be improved by stabilizers well known to those skilled in the art (see, e.g., F. W. Billmeyer, Textbook of Polymer Chemistry, Interscience Publishers, Inc., New York (1957) p. 311-315).

The resin support may contain pigments or dyes as colouring matter e.g. in an amount up to 5% by weight. An opaque white appearance may be obtained by incorporation of white pigments, e.g. titanium dioxide particles.

In the dye image-receiving material according to the present invention the cationic polymeric mordant containing a glycidyl groups that can react with active hydrogen is preferablya basic polyurethane polyurea or polyurea-polyurethane consisting of from 0 to 30 mole % of recurring units derived from a modifying monomer selected from the group consisting of monofunctional and trifunctional alcohols, amines, and isocyanates and from 70 to 100 mole % of recurring units of the general formula in which segment A corresponds to the general formula:

$$(-A-B-)$$

in which segment A corresponds to the general formula:

$$-X_1-(CH_2)_{m1}-\overset{R^1}{\overset{|}{N}}-(CH_2)_{m2}-X_2-$$

wherein:

$R_1$ represents a straight or branched chain alkyl, alkoxyalkyl, aralkyl or a disubstituted aminoalkyl group of the formula:

$$(R_2)(R_3)N-(CH_2)_{m3}-$$

or an ethylene or 1,2-propylene group which is attached to $X_1$ or $X_2$ through the second bond with formation of a piperazine ring, each of $R_2$ and $R_3$ (same or different) represents a $C_1$-$C_4$ alkyl group or together represent the atoms required to complete a pyrrolidine, piperidine or morpholine ring, each of $X_1$ and $X_2$ (same or different), respresents, —O—, —NH—, —$NR_4$— or a group of the formula —$NR_4$—$(CH_2)$m4—$X_3$— in which:

$R_4$ represents an alkyl group having from 1 to 4 carbon atoms or when only one of the groups $X_1$ or $X_2$ is —$NR_4$—$(CH_2)$m4—$X_3$—, $R_4$ may together with $R_1$ form an ethylene or a 1,2-propylene group, $X_1$ represents —O—, —NH— or —$NR_4$— and may be the same as or different from $X_1$ and $X_2$, and m1 to m4 represent 2 or 3, but in the case of m1 or m2 only the value 2 may occur when $R_1$ and $R_4$ together form an ethylene or 1,2-propylene group, and wherein segment A contains up to 40% of the bivalent tertiary amino group quaternized with a quaternizing agent carrying glycidyl groups, and the remainder of said tertiary amino groups being at least partially:

(i) quaternized with quaternizing agents absent glycidyl groups, or (ii) neutralized with an acid, and in which segment B corresponds to the formula:

$$-CO-Y-CO-$$

wherein

Y represents, same or different, —O—$R_5$—O—, —NH—$R_6$—NH— or —NH—$R_6$—NH—CO—O—$R_7$—O—CO—NH—$R_6$—NH—, wherein:

$R_5$ represents an alkylene group unsubstituted or substituted with alkyl or interrupted by ether oxygen atoms, $R_6$ represents an alkylene group unsubstituted or substituted with alkyl groups, a cycloalkylene group or an arylene group, and $R_7$ represents any divalent group not containing a Zerewitinoff active group or a group capable of reacting with isocyanate groups, provided that Y can represent —$OR_5O$— only when $X_1$, $X_2$ or $X_3$ are not —O—.

The preparation of said cationic polymeric mordant proceeds as described in U.S. Pat. No. 4,186,014.

A mordant having particularly good fixing power for anionic dyes is called mordant M and has the following structure (the percentage values are mole %):

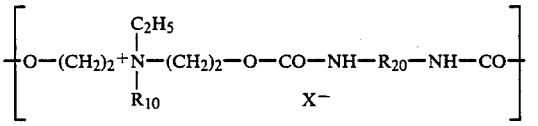

(80%)

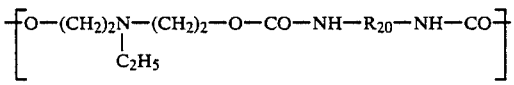

(20%)

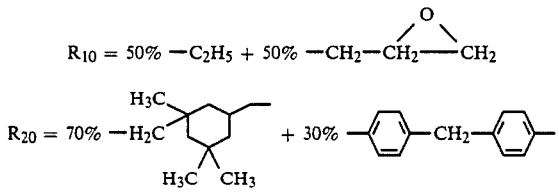

$X^- = 50\%\ C_2H_5SO_4^- + 50\%\ Cl^-$

Said mordant is prepared analogously to Example 12 of U.S. Pat. No. 4,186,014.

An image receiving layer on the basis of said mordant has a high resistance to abrasion and yields very rapidly a touch dry dye image.

Generally, good results are obtained when the dye image-receiving layer is about 2 to about 10 μm thick. This thickness, of course, can be modified depending upon the result desired.

The image-receiving layer for use according to the present invention may contain ultraviolet-absorbing materials to protect the mordanted dye images from fading, brightening agents such as the stilbenes, coumarins, triazines, oxazoles, and dye stabilizers such as the chromanols, alkyl-phenols, etc.

Use of pH-lowering material in the dye-imaging-receiving element will usually increase the stability of the transferred image. Generally, the pH-lowering material will effect a reduction of the pH of the image layer from about 13 to 14 to at least 11 and preferably to 5 to 7 within a short time after treatment. For example, polymeric acids as disclosed in U.S. Pat. No. 3,362,819 of Edwin H. Land, issued Jan. 9, 1968, or solid acids or metal salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

In order to improve the coating speed of the subbing layer composition to the resin support the latter is pretreated with a corona discharge by passing the support, e.g. in sheet or belt form, between a grounded conductive roller and corona wires whereto an alternating current (AC) voltage is applied with sufficiently high potential to cause ionization of the air. Preferably the applied peak voltage is in the range of 10 to 20 kV. An AC corona unit is preferred because it does not need the use of a costly rectifier unit and the voltage level can be easily adapted with a transformer. In corona-discharge treatment with an an AC corona unit a frequency range from 10 to 100 kHz is particularly useful. The corona-treatment can be carried out with material in the form of a ble tor band at a speed of 10 to 30 m per min while operating the corona unit with a current in the range of 0.4 to 0.6 A over a belt or band width of 25 cm.

The corona-discharge treatment makes it possible to dispense with a solvent treatment for attacking and roughening the surface of the resin support and is less expensive and more refined in its application.

The formation of a dye image in the image-receiving material according to the present invention may proceed by any dye transfer processing technique wherein the image-wise exposure of (a) silver halide emulsion layer(s) and the development thereof result in an image-wise dye transfer to an image-receiving layer.

After the obtaining of the dye image in the image receiving layer it is advantageous to remove adhering chemicals stemming from e.g. the photographic processing or used in that processing. It has been established experimentally that chemicals such as photographic silver halide developing agents impair the adherence in a lamination step and therefore a cleaning step is preceding preferably the lamination of removing these chemicals. The cleaning proceeds preferably with the aid of a dissolved detergent that diminishes the surface tension in aqueous medium. Any commercial detergent can be used for that purpose. A survey of detergents can be found in the book: "McCutcheon's Detergents & Emulsifiers" 1978 North American Edition - McCutcheon Division, MC Publishing Co. 175 Rock Road, Glen Rock, N.J. 07452 USA. Preference is given to anionic and non-ionic surface-active agents containing a polyethyleneoxide chain in their structure. Examples of such agents are described in U.S. Pat. No. 3,663,229.

The image-receiving layer can form part of a separate image-receiving material or form an integral combination with the light-sensitive silver halide emulsion layer(s) of the photographic material with the proviso that the image receiving layer makes contact with a transparent vinyl chloride polymer support.

Where the image-receiving layer applied on said support after processing of the photosensitive mateiral remains associated with the silver halide emulsion layer(s) an alkali-permeable light-shielding layer, e.g. containing white pigment particles is applied between the image-receiving layer and the silver halide emulsion layer(s) to mask the negative image with respect to the positive image as described e.g. in the book: "Photographic Silver Halide Diffusion Processes" by AndréRott and Edith Weyde - The Focal Press - London - New York (1972) page 141.

The image-receiving material according to the present invention is particularly suited for application in the production of laminar articles for use as an identification document, also called I.D. card, that contains a colour photograph by lamination sandwiched between a clear resin protective cover sheet and a possibly opaque resin support sheet.

In view of the widespread use of I.D. Cards as security document, e.g. to establish a person's authorization to conduct certain activities (e.g. driver's license) or to have access to certain areas or to engage in particular commercial actions, it is important that forgery of the I.D. Card by alteration of certain of its data and/or photograph is made impossible.

A laminar article according to the present invention comprises the above defined image receiving layer incorporating a dye image enveloped between a resin support, preferably vinyl chloride polymer support and a resin cover sheet fixed to the image receiving layer by lamination using pressure and heat.

The cover sheet may be any hydrophobic thermoplastic resin sheet, e.g. made of polyester resin such as polyethylene terephthalate, a polycarbonate of a bisphenol, a polyolefin e.g. polyethylene or polypropylene, or a vinyl chloride polymer as defined herein. According to a particular embodiment the cover sheet is a polyethylene terephthalate sheet being coated with a resinous melt adhesive layer, preferably a polyethylene layer.

The lamination of the present image receiving material with said resin cover sheet proceeds preferably by heat-sealing between flat steel plates under a pressure of e.g. 10 to 15 kg/cm2 at a temperature in the range of 120° to 150° C., e.g. at 135° C. or by using other apparatus available on the market for heat sealing lamination purposes. Cooling proceeds under pressure to avoid distortion.

The laminate may contain the image receiving layer over the whole area of the support or in a part thereof, e.g. leaving free the edge area as described in U.S. Pat. No. 4,425,421.

According to an embodiment the image receiving layer is coated onto an opaque polyvinyl chloride having a thickness of only 0.050 to 0.300 mm. A sheet of that thickness can receive printed data by means of a mechanical printing process, e.g. offset or intaglio printing. It can receive, before or after being coated with the image receiving layer, or before or after the dye transfer, additional security marks in the form of e.g. a watermark, finger prints, printed patterns known from banc notes, coded information, e.g. binary code information, signature or other printed personal data that may be applied with visibly legible or ultra-violet legible printing inks as described e.g. in GB-P 1,518,946 and U.S. Pat. No. 4,105,333.

Other possibilities to icnrease security against counterfeiting are the inclusion in the laminate or pigments, infra-red absorbing markings, magnetic dots or strips and electronic microcircuits either or not combined with ultra-violet radiation absorbing markings hidden from visibility and/or holograms as described e.g. in DE-OS 2,639,952, GB-P 1,502,460 and 1,572,442 and U.S. Pat. No. 3,668,795. The holographic patterns may be obtained in silver halide emulsion layers, normally Lippmann emulsions, especially designed for that purpose and can either or not be combined with a photograph.

According to an embodiment the silver halide emulsion layer for producing the hologram is applied on one side of the transparent cover sheet used in the manufacture of a laminate according to the present invention and laminated to the image receiving layer either or not separated therefrom by a transparent resin intersheet being made of polyethylene or a resin sheet such as a polyvinyl chloride sheet being coated with polyethylene.

According to an embodiment wherein the resin sheet used as support of the laminate has to possess a thickness required for an identification card to be inserted in a slot of an electronic identification apparatus several sheets of matted polyvinyl chloride are stacked and laminated so as to reach a final thickness of e.g. 0.075 to 1 mm. When this lamination to the desired thickness occurs after dye image formation on a relatively thin polyvinyl chloride support, treatment with detergent as referred to hereinbefore to remove adhering chemicals preferably preceeds the lamination. The laminar article contains in that case preferably in the polyvinyl chloride support sheet opacifying titanium dioxide and a suitable plasticizing agent. The support may be provided with an embossed structure.

The following example illustrates the present invention without, however, limiting it thereto.

All parts, ratios and percentages are by weight unless otherwise stated.

EXAMPLE

Eight identical DIN A4 sheets of polyvinyl chloride made opaque with titanium dioxide and having a width of 24 cm and a thickness of 200 μm were treated under the same circumstances with an electrical discharge produced by a corona discharge apparatus operated under the following conditions:

film travelling speed: 20 m/min,
electrode spacing to sheet surface: 2 mm,
corona current: 0.55 A,
AC voltage difference (peak value): 10 kV,
frequency: 30 kHz.

As defined in the following Table 2 the corona-treated sheets were coated respectively with one of the following subbing coating compositions 1 to 8 followed as indicated by the coating with one of the corresponding mordant layer (image receiving layer) compositions 1 to 8, all the ingredients being expressed in g per m2.

TABLE 2

| | Compositions | | | | | | | |
|---|---|---|---|---|---|---|---|---|
| | 1 | 2 | 3 | 4 | 5 | 6 | 7 | 8 |
| Subbing layer | | | | | | | | |
| Ingredient A | 0.4 | 2.0 | 4.0 | 2.0 | 2.0 | 2.0 | 2.0 | 2.0 |
| Ingredient B | — | — | — | 0.2 | 0.4 | 1.0 | 0.4 | 0.4 |
| Mordant layer | | | | | | | | |
| Ingredient C | 2.25 | 2.25 | 2.25 | 2.25 | 2.25 | 2.25 | 2.25 | 2.25 |
| Ingredient D | 0.9 | 5.15 | 7.15 | 5.35 | 5.55 | 6.15 | 4.75 | 6.90 |

"Ingredient A" is the anionic polyester-urethane the composition of which has been defined hereinbefore.
Ingredients B and D are gelatin.
Ingredients C is the mordant M as described hereinbefore.

The aqueous coating compositions of the subbing layers 1 to 8 contain a common spreading agent and with respect to 250 ml of ingredient A 125 ml of a 5% solution in ethanol of siloxane compound No. 9 in an amount of 6.25% with respect to ingredient A.

The subbing layer compositions were applied at a wet coverage of 20 g per m2.

The above image receiving sheets were processed in combination with a photographic dye diffusion transfer material as described in the Example of U.S. Pat. No. 4,496,645. Said photographic material was exposed with white light through a grey wedge having a constant 0.1 and thereupon contacted for 1 minute with an image receiving material having the composition described above in a diffusion transfer apparatus COPYPROOF CP 38 (trade name of Agfa-Cevaert N.V. Belgium) ) having in its tray a basic processing liquid of the following composition:

| | |
|---|---|
| sodium hydroxide | 25 g |
| sodium orthophosphate | 25 g |
| cyclohexane dimethanol | 25 g |
| 2,2'-methylpropylpropane diol | 25 g |
| N—ethylbenzene-pyridinium chloride | 0.5 g |
| distilled water up to | 1000 ml |

After leaving the processing tray the sheets were led through a second tray containing an aqueous solution comprising 50 g/l of a surfactant having the following structural formula:

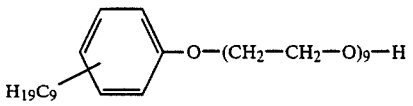

After drying the thus treated sheets were laminated with a transparent cover sheet being a polypropylene sheet having a thickness of 30 um being coated at one side with a thermoadhesive layer of polyethylene having a thickness of 30 um. The lamination was carried out between flat steel plates pressing the layers together for 5 minutes using a pressure of 10 kg/cm2 at a temperature of 135° C. Said pressure was maintained during cooling to reach room temperature (20° C.) again.

The obtained 8 laminates have a sealing thus strong that even in wet state peeling apart of the cover sheet is no longer possible without destroying the dye image.

We claim:

1. A dye image-receiving material suitable for image production by dye diffusion transfer processing controlled by development of image-wise exposed silver halide emulsion layer(s), wherein said image-receiving material contains a hydrophobic resin support coated with a subbing layer that is coated with said image-receiving layer containing gelatin in combination with a cationic polymeric mordant which is a basic polyurethane polyurea or polyurea-polyurethane consisting of from 0 to 30 mole % of recurring units derived from a modifying monomer selected from the group consisting of monofunctional and trifunctional alcohols, amines, and isocyanates and from 70 to 100 mole % of recurring units of the general formula $$(-A-B-)$$

in which segment A corresponds to the general formula:

$$-X_1-(CH_2)_{m1}-\overset{\overset{\displaystyle R^1}{|}}{N}-(CH_2)_{m2}-X_2-$$

wherein:

$R_1$ represents a straight or branched chain alkyl, alkoxyalkyl, aralkyl or a disubstituted aminoalkyl group of the formula:

$$\begin{matrix} R_2 \\ R^3 \end{matrix}\!\!>N-(CH_2)_{m3}-$$

or an ethylene or 1,2-propylene group which is attached to $X_1$ or $X_2$ through the second bond with formation of a piperazine ring, each of $R_2$ and $R_3$ (same or different) represents a C1-C4 alkyl group or together represent the atoms required to complete a pyrrolidine, piperidine or morphiline ring, each of $X_1$ and $X_2$ (same or different) represents —O—, —NH—, —$NR_4$—, or a group of the formula —$NR_4$—$(CH_2)$-m4—$X_3$— in which:

$R_4$ represents an alkyl group having from 1 to 4 carbon atoms or when only one of the groups $X_1$ or $X_2$ is —$NR_4$—$(CH_2)$m4—$X_3$—, $R_4$ may together with $R_1$ form an ethylene or a 1,2-propylene group, $X_3$ represents —o—, —NH— or —$NR_4$— and may be the same as or different from $X_1$ or $X_2$, and m1 to m4 represents 2 or 3, but in the case of m1 or m2 only the value 2 may occur when $R_1$ and $R_4$ together form an ethylene or 1,2-propylene group, and wherein segment A contains up to 40% of the bivalent tertiary amino group quaternized with a quaternizing agent carrying glycidyl groups, and the remainder of the tertiary amino groups being at least partially:

(i) quaternized with quaternizing agents absent glycidyl groups, or (ii) neutralized with an acid, and in which segment B corresponds to the formula:

$$-CO-Y-CO-$$

wherein Y represents, same or different, —O—$R_5$—O—,

—NH—$R_6$—NH— or —NH—$R_6$—NH—CO—O—$R_7$—O—CO—NH—$R_6$—NH—, wherein:

$R_5$ represents an alkylene group unsubstituted or substituted with alkyl or interrupted by ether oxygen atoms, $R_6$ represents an alkylene group unsubstituted or substituted with alkyl groups, a cycloalkylene group or an arylene group, and $R_7$ represents any divalent group not containing any Zerewitinoff active group or a group capable of reacting with isocyanate groups, provided that Y can represent —$OR_5O$ only when $X_1$, $X_2$ or $X_3$ are not —O—;

characterized in that the weight ratio of said polymeric mordant to gelatin in said image-receiving layer is between 25:1 to 1:1 and the gelatin is present therein at a coverage of at least 0.1 g per $m^2$, and in that said subbing layer has been applied from an aqueous composition comprising a polyester-polyurethane wherein isocyanate groups still present in its structure have reacted with an ionomeric compound containing at least one active hydrogen atom and a carboxylate or sulphonate salt group forming an anionic polyesterpolyurethane.

2. An image-receiving material according to claim 1, wherein the sulfonate and/or carboxylate groups total from 0.5 to 15% by weight with respect to said anionic polyester-polyurethane.

3. An image-receiving material according to claim 1, wherein said polyester-polyurethane used as starting product in the reaction with said ionomeric compound is a polyurethane of an essentially linear polyester compound that has two terminal hydroxyl groups, the polyester having preferably a molecular weight of about 300 to about 20,000.

4. An image-receiving material according to claim 1, wherein said anionic polyester-polyurethane contains linear polyester structural parts corresponding with a polyester derived from a dicarboxylic acid containing up to 6 carbon atoms and a polyhydric aliphatic alcohol containing up to 6 carbon atoms.

5. An image-receiving material according to claim 1, wherein said anionic polyester-polyurethane is the reaction product of:

(1) the polyester of apipic acid and hexanediol with average
molecular weight 840, (23%),
(2) 4,4'-diisocyanato-dicyclohexylmethane (14%),
(3) dimethylolpropionic acid(2%), and
(4) trimethylamine (1.5%), the given percentages being by weight, said reaction product being dispersed in water containing 7.5% by weight of N-methylpyrrolidinone.

6. An image-receiving material according to claim 1, wherein the subbing layer has been applied from an aqueous coating composition containing a siloxane.

7. An image-receiving material according to claim 1, wherein the support is made of a polyester resin, a polycarbonate of bis-phenol, a polyolefin, polystyrene or a vinyl chloride polymer.

8. A laminar article comprising a dye image produced in an image-receiving material suitable for image production by dye diffusion transfer processing controlled by development of (an) image-wise exposed silver halide emulsion layer(s), wherein said image-receiving material contains a hydrophobic resin support coated with a subbing layer that is coated with said image-receiving layer containing gelatin in combination with a cationic polymeric mordant which is a basic polyurethane polyurea or polyurea-polyurethane consisting of from 0 to 30 mole % of recurring units derived from a modifying monomer selected from the group consisting of monofunctional and trifunctional alcohols, amines, and isocyanates and from 70 to 100 mole % of recurring units of the general formula $$(-A-B-)$$

in which segment A corresponds to the general formula:

$$-X_1-(CH_2)_{m1}-\overset{\overset{R^1}{|}}{N}-(CH_2)_{m2}-X_2-$$

wherein:

$R_1$ represents a straight or branched chain alkyl, alkoxyalkyl, aralkyl or a disubstituted aminoalkyl group of the formula:

$$\begin{matrix} R_2 \\ R^3 \end{matrix}\!\!>N-(CH_2)_{m3}-$$

or an ethylene or 1,2-propylene group which is attached to $X_1$ or $X_2$ through the second bond with formation of a piperazine ring, each of $R_2$ and $R_3$ (same or different) represents a C1-C4 alkyl group or together represent the atoms required to complete a pyrrolidine, pipeidine or morphiline ring, each of $X_1$ and $X_2$ (same or different) represents —O—, —NH—, —$NR_4$—, or a group of the formula —$NR_4$—$(CH_2)$-m4—$X_3$— in which:

$R_4$ represents an alkyl group having from 1 to 4 carbon atoms or when only one of the groups $X_1$ or $X_2$ is —$NR_4$—$(CH_2)$m4—$X_3$—, $R_4$ may together with $R_1$ form an ethylene or a 1,2-propylene group, $X_3$ represents —O—, —NH— or —$NR_4$— and may be the same as or different from $X_1$ or $X_2$, and m1 to m4 represents 2 or 3, but in the case of m1 or m2 only the value 2 may occur when $R_1$ and $R_4$ together form an ethylene or 1,2-propylene group, and wherein segment A contains up to 40% of the bivalent tertiary amino group quaternized with a quaternizing agent carrying glycidyl groups, and the remainder of the teritary amino groups being at least partially:

(i) quaternized with quaternizing agents absent glycidyl groups, or
(ii) neutralized with an acid, and in which segment B corresponds to the formula:

$$-CO-Y-CO-$$

wherein Y represents , same or different, —O—$R_5$—O—,

—NH—$R_6$—NH— or —NH—$R_6$—NH—CO—O—$R_7$—O—CO—NH—$R_6$—NH—, wherein:

$R_5$ represents an alkylene group unsubstituted or substituted with alkyl or interrupted by ether oxygen atoms, $R_6$ represents an alkylene group unsubstituted or substituted with alkyl groups, a cycloalkylene group or an arylene group, and $R_7$ represents any divalent group not containing any Zerewitinoff active group or a group capable of reacting with isocyanate groups, provided that Y can represent —$OR_5O$ only when $X_1$, $X_2$ or $X_3$ are not —O—;

characterized in that the weight ratio of said polymeric mordant to gelatin in said image-receiving layer is between 25:1 to 1:1 and the gelatin is present therein at a converage of at least 0.1 g per $m^2$, and in that said subbing layer has been applied from an aqueous composition comprising a polyester-polyurethane wherein isocyanate groups still present in its structure have reacted with an ionomeric compound containing at least one active hydrogen atom and a carobxylate or sulphonate salt group forming an anionic polyesterpolyurethane, and wherein the image-receiving layer is enveloped between a vinyl chloride polymer support and a resin cover sheet fixed to the image-receiving layer by lamination using pressure and heat.

9. A laminar article according to claim 8, wherein the resin cover sheet is a polyethylene terephthalate sheet being coated with a resinous melt-adhesive layer.

10. A laminar article according to claim 9, wherein the resinous melt-adhesive layer is a polyethylene layer.

* * * * *